US006375240B1

(12) United States Patent
Lindberg

(10) Patent No.: US 6,375,240 B1
(45) Date of Patent: Apr. 23, 2002

(54) VACUUM GRIPPING APPARATUS

(75) Inventor: Teppo Lindberg, Nuppulinna (FI)

(73) Assignee: KCI Konecranes International PLC, Hyvinkää (FI)

( * ) Notice: Subject to any disclaimer, the term of this patent is extended or adjusted under 35 U.S.C. 154(b) by 0 days.

(21) Appl. No.: 09/582,331

(22) PCT Filed: Oct. 22, 1999

(86) PCT No.: PCT/FI99/00882

§ 371 Date: Jun. 23, 2000

§ 102(e) Date: Jun. 23, 2000

(87) PCT Pub. No.: WO00/24665

PCT Pub. Date: May 4, 2000

(30) Foreign Application Priority Data

Oct. 23, 1998 (FI) ..... 982299

(51) Int. Cl.[7] ..... B66C 1/02
(52) U.S. Cl. ..... 294/64.1
(58) Field of Search ..... 294/64.1, 65; 269/21; 414/627, 737, 752.1; 901/40

(56) References Cited

U.S. PATENT DOCUMENTS

| | | | | | |
|---|---|---|---|---|---|
| 1,505,626 | A | * | 8/1924 | Debaecker | 294/65 |
| 3,376,061 | A | * | 4/1968 | Harris et al. | 294/64.1 |
| 3,758,144 | A | | 9/1973 | Dalglish | |
| 3,833,251 | A | * | 9/1974 | Creskoff | 294/64.1 |
| 3,926,466 | A | | 12/1975 | Carpenter | |
| 4,925,225 | A | * | 5/1990 | Dost | 294/64.1 |
| 5,242,256 | A | | 9/1993 | Appel | |
| 5,310,232 | A | * | 5/1994 | Schmidt | 294/64.1 |

FOREIGN PATENT DOCUMENTS

| | | |
|---|---|---|
| DE | U1-84351616 | 5/1985 |
| FI | B094615 | 6/1995 |
| WO | A1-9843909 | 10/1998 |

* cited by examiner

*Primary Examiner*—Johnny D. Cherry
(74) *Attorney, Agent, or Firm*—Birch, Stewart, Kolasch & Birch, LLP

(57) ABSTRACT

The invention relates to a vacuum gripping apparatus for moving roll-like loads, the loads being piled on top of each other and resting on their even end faces, the vacuum gripping apparatus comprising a suction plate (3) to be arranged against the end face of a load, the outer circumference (12) of the suction plate being provided with corner portions (19), side edges (21) that connect the corners of the portions being curved inward, that the outer circumference (12) of the suction plate (3) determines the maximum lateral dimensions of the structure above the suction plate.

8 Claims, 3 Drawing Sheets

VACUUM GRIPPING APPARATUS

This application is the national phase under 35 U.S.C. § 371 of PCT International Application No. PCT/FI99/00882 which has an International filing date of Oct. 22, 1999, which designated the United States of America.

BACKGROUND OF THE INVENTION

The invention relates to a vacuum gripping apparatus for moving roll-like loads, the loads being piled on top of each other and resting on their even end faces and the vacuum gripping apparatus comprising a suction plate to be arranged against the end face of a load.

The described vacuum gripping apparatus can be used for lifting and moving rolls of reeled paper, metal, plastic or laminate, for example. It can also be used for moving cylindrical hollow pieces having even end faces. The vacuum gripping apparatus can be liftably and lowerably suspended to a lifting device of a crane, although other lifting apparatuses can also be used.

A conventional prior art vacuum gripping apparatus is described in publication DE-U 84 35 161. The apparatus comprises an even suction plate in the lower portion, with several concentric ring seals arranged at a distance onto the underside of the suction plate to provide the gripping surface. When the suction plate is placed down onto the end face providing the gripping surface of the load, the ring seals form vacuum spaces, separated from one another, between the suction plate and the load to be transported. Naturally the ring seals do not have to be circular but they may have any other form, too; they may be elliptical or angular, for example, as long as they form a closed ring. It is not absolutely necessary that the ring seals are within each other either. It is also possible to arrange several vacuum spaces formed at a distance from one another.

The vacuum spaces are connected through holes provided in the suction plate and a connecting conduit comprising a valve to a vacuum source comprising a vacuum generator. When there is no load suspended from the vacuum gripping apparatus, the connection to the suction generator is cut off and the vacuum space or spaces are ventilated.

To lift a load, the vacuum gripping apparatus is lowered onto the load and the valve device is set in a suction position, thereby creating a connection between the vacuum source and the vacuum space or spaces. If several vacuum spaces are used, several valves can also be arranged, the valves being arranged in such a way that the connection to the vacuum source opens only when the vacuum space in question is fully covered by the load gripping surface. When the vacuum space or spaces have been subjected to a sufficient vacuum in the lifting process, the load can be lifted or moved.

After the load has been lifted or deposited, the valve device is switched from the suction position back to the ventilation position. The vacuum gripping apparatus can then be lifted with the lifting device from the lowered load.

The above described vacuum gripping apparatus comprises a vacuum container above the suction plate, the container and the suction plate both having a circular horizontal cross-sectional form. The upper surface of the container provides a mounting surface for arranging various kinds of aggregates and devices that are necessary for the use of a vacuum lifting apparatus.

Roll stacks can be more than 12 m high, so due to reasons of space, they must be arranged extremely close to each other. For roll diameters up to 2500 mm, the minimum free distance between two roll stacks can be 100 mm, for example. To prevent the vacuum gripping apparatus from colliding with the roll stacks when the apparatus is driven into a cavity surrounded by the roll stacks, the apparatus may not be greater than the maximum diameter of the roll to be received.

Various solutions have been presented to solve the problems of space thus arising in the mounting of the aggregates and other devices needed in the vacuum gripping apparatus. It has been suggested that separate aggregates would be removed from the vacuum gripping apparatus and arranged to the lifting apparatus. On the other hand, FI Patent 94615 proposes that the mounting space in question would be formed into a hexagon, as this would allow optimal use of the space between the roll stacks without increasing the risk of collision with the roll stacks, thereby providing more mounting space for the aggregates.

If it is necessary to store rolls of clearly different diameters (two different diameters, for example) into one and the same storage area, the most reasonable way to utilize the space is to store the rolls in a matrix format according to size. Current technology requires that the diameter of the vacuum gripping apparatus, and that of the suction plate in particular, must be selected according to the smaller (or the smallest) matrix. Depending on the weight of a roll, sufficient suction power ensuring safe lifting of rolls of a greater diameter cannot always be provided. On the other hand, a small suction diameter is not enough to support the end surface of looser rolls, and the form of the rolls cannot be maintained during the lifting.

BRIEF DESCRIPTION OF THE INVENTION

An object of the present invention is to solve the last one of the above problems. The object is achieved with a vacuum gripping apparatus according to the invention, characterized in that the outer circumference of the suction plate is provided with corner portions, the side edges connecting the corners of the portions being curved inward, and that the outer circumference of the suction plate determines the maximum lateral dimensions of the structure above the suction plate.

The invention, particularly as regards the suction plate, is based on the fact that the minimum distance between a roll stack and the surrounding roll stacks is always at one point only, i.e. on the lines connecting the centers of the roll stacks. Between the connecting lines the distance is longer, free surfaces being thus formed. The invention is based on the idea of utilizing the surface areas, in the suction plate in particular, without increasing the risk of collision with adjacent roll stacks. The only restriction on the upper structure is that it is not to extend beyond the edges of the suction plate in lateral direction. The upper structure can thus be a prior art structure, for example, or like the one presented in the solution of the above mentioned FI Patent. The most essential objective is therefore to increase suction power by maximizing the surface of the suction plate.

To optimally utilize the space between the roll stacks, the number and form of the corner portions in the suction plate can be adjusted according to a particular arrangement of roll stacks in storage.

Most commonly, in modern storage areas, roll stacks are arranged in such a way that the centers of the roll stacks form the corners of equilateral triangles. The appropriate form for the outer circumference of the suction plate of the invention is a regular polygon, preferably a hexagon. In other roll stack arrangements, different polygons optimally utilizing the available space are naturally possible.

A particularly large increase in surface is obtained by curving inward the side edges connecting the corners of the corner portions, most preferably into an arch form. In concrete applications this is appropriately achieved when the arch-formed side edges are concentric with adjacent roll stacks in such a way the side edges are at their entire length at the allowed minimum distance from the adjacent roll stacks, the free space thus being optimally used. To avoid sharp-edged corners, the edges should preferably be bevelled.

To allow the obtained increase in suction plate surface to provide a maximum increase in suction force, the outermost seal edge of the seal arrangement on the underside of the suction plate should follow the form of the outer circumference of the suction plate as close to the edge of the outer circumference as possible.

BRIEF DESCRIPTION OF THE DRAWINGS

In the following the invention will be described in connection with one example of a preferred embodiment, with reference to the accompanying drawings in which.

DETAILED DESCRIPTION OF THE INVENTION

Figure 1:
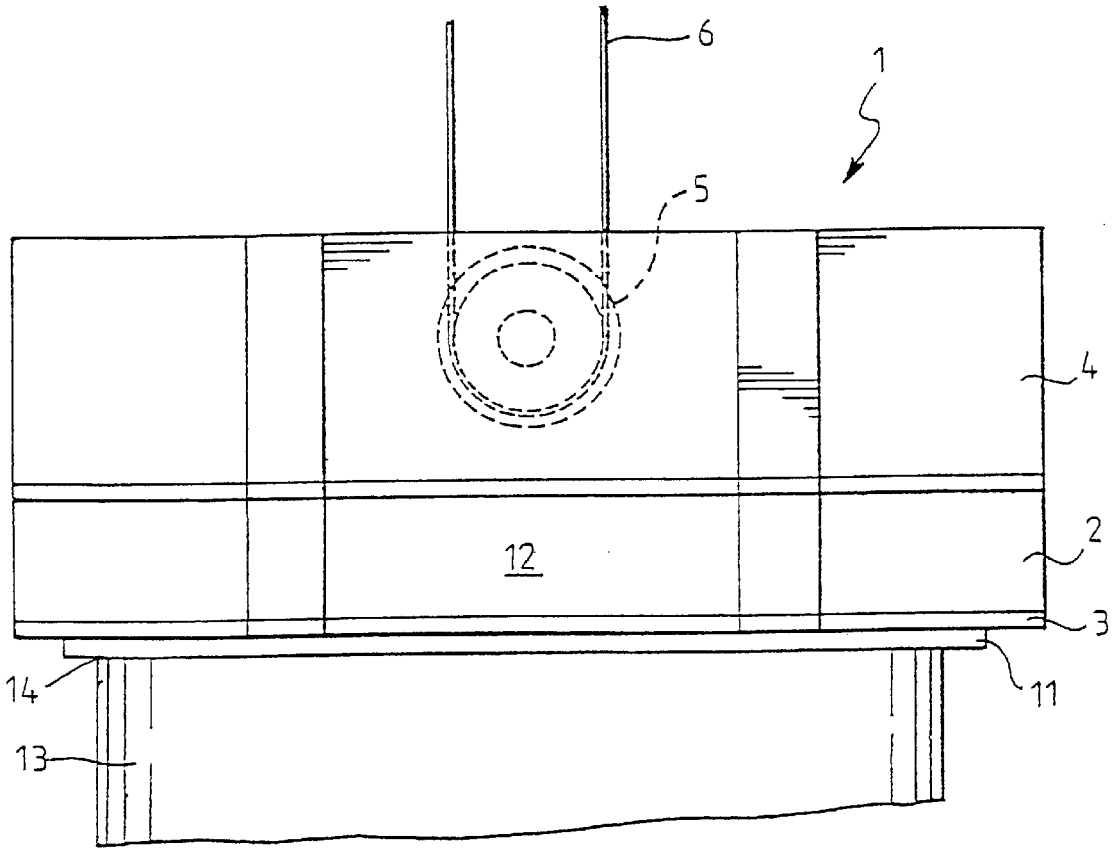
FIG. 1 is a side view illustrating a vacuum gripping apparatus of the invention and a paper roll.
Figure 2:
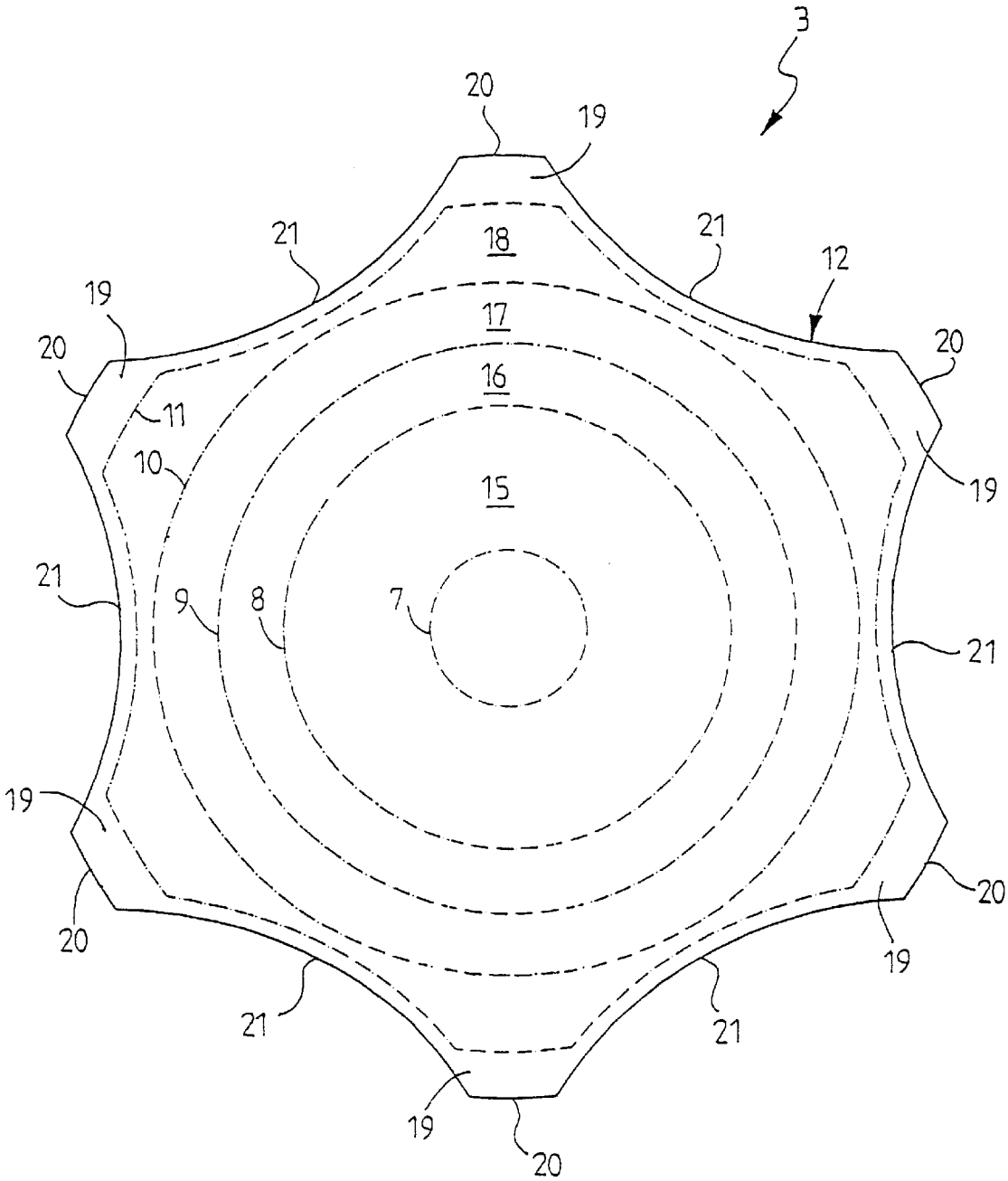
FIG. 2 illustrates a suction plate of the vacuum gripping apparatus of the invention seen from below.

A lower portion of a vacuum gripping apparatus 1 shown in FIG. 1 is provided with a vacuum container 2 connected to a vacuum generator not shown here. A suction plate 3 closes the underside of the vacuum container 2, a casing 4 being arranged above the vacuum container 2, the casing enclosing aggregates and devices, such as the vacuum generator, an emergency vacuum generator, batteries, electric switches, etc., associated with the vacuum gripping apparatus 1 and not described in detail in this context. In addition, inside the casing 4 there are pivoted guiding rolls 5 via which the vacuum gripping apparatus is liftably and lowerably suspended on ropes 6 of a lifting apparatus not described here in detail.

The underside of the suction plate 3 is provided with seal rings 7 to 11 arranged one inside the other, the outermost seal ring 11 following the form of the outer circumference 12 of the suction plate 3, close to the outer circumference 12. Together with a top surface 14 of a paper roll 13, the seal rings 7 to 11 form vacuum spaces 15 to 18 for lifting the paper roll 13 by applying a vacuum generated into the spaces.

The suction plate 3 is formed here as a substantially regular hexagon comprising corner portions 19 provided with bevels 20 to avoid sharp corners. Side edges 21 starting at the edges of the bevels 20 are inward concave, and to arrange the side edges with adjacent paper roll stacks 22 and 23 (FIGS. 3 and 4), the side edges 21 are arranged concentric with the adjacent paper roll stacks 22 and 23. The suction plate 3 is thereby provided with the greatest surface possible, maintaining at the same time the allowed distance between the side edges 21 and the covering surfaces of the paper roll stacks 22 and 23, particularly in the case shown in FIG. 3.

The vacuum container 2 and the casing 4 can be made into any form, provided that their contours do not extend beyond the outer circumference 12 of the suction plate 3 in lateral direction and that a vacuum can be provided into all vacuum spaces 15 to 18 when needed. In the example concerned, the described vacuum container 2 and casing 4 can be imagined to have a horizontal cross-section substantially of the same form as the suction plate 3.

Figure 3:
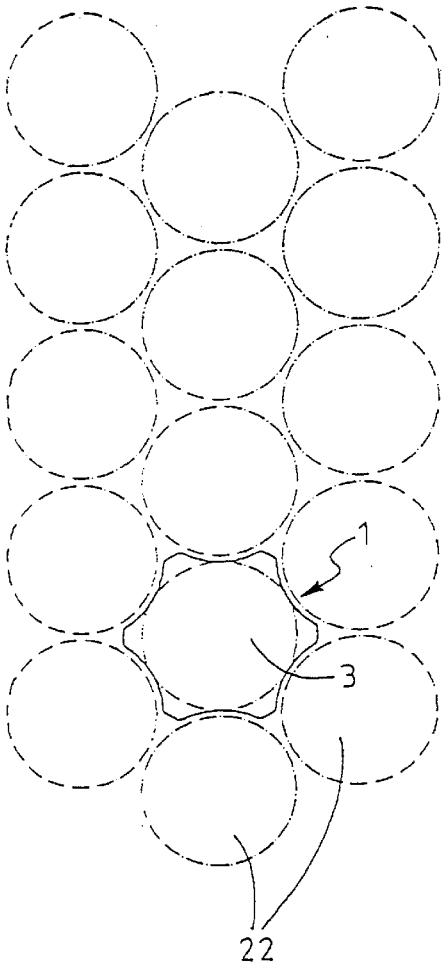
FIGS. 3 and 4 illustrate two matrices formed of rolls of different sizes, i.e. two ways of arranging rolls into a storage.
Figure 4:
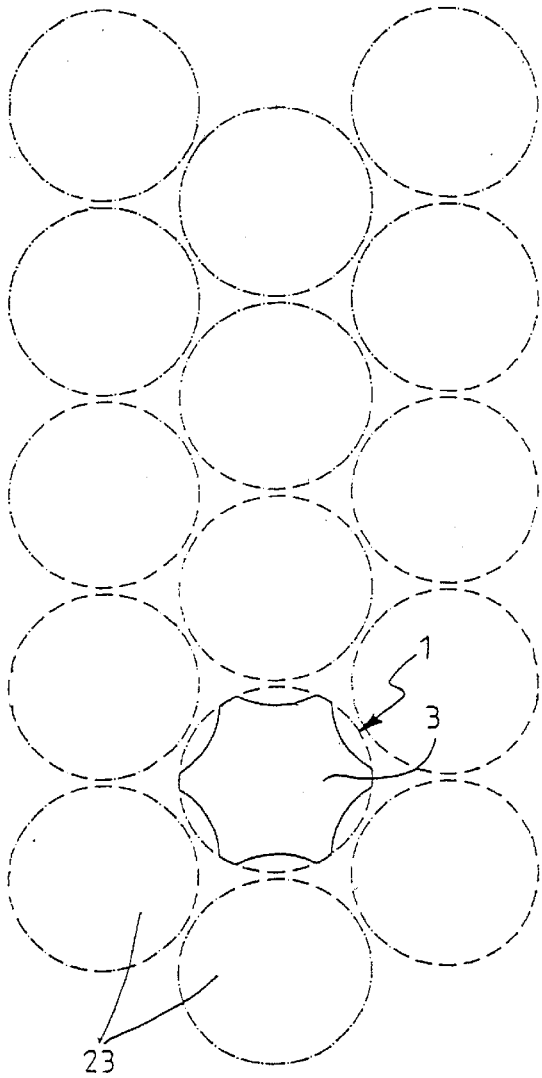

In FIGS. 3 and 4 the vacuum gripping apparatus 1 is driven between paper roll stacks 22 and 23, respectively, the suction plate forming the outer contours of the vacuum gripping apparatus. The paper roll stacks 22 and 23 are arranged in such a way that their midpoints form the corners of an equilateral triangle, a maximum packing density being thereby obtained. The vacuum gripping apparatus 1 being provided with the suction plate 3 of the invention, the suction plate is able to lift rolls of considerably different sizes because, on one hand, it fits between paper roll stacks 22 of a smaller diameter and, on the other hand, it has sufficient suction power enabling rolls in paper roll stacks 23 of considerably larger diameter to be lifted.

The above description of the invention is only meant to illustrate the invention. A person skilled in the art may implement details of the invention in various alternative ways within the scope of the appended claims.

What is claimed is:

1. A vacuum gripping apparatus for moving roll-like loads (13), the loads being piled on top of each other and resting on their end faces and the vacuum gripping apparatus (1) comprising a suction plate (3) to be arranged against the end face of a load, characterized in that the outer circumference (12) of the suction plate (3) is provided with corner portions (19), the side edges (21) connecting the corners of the portions being curved inward, and that the outer circumference (12) of the suction plate (3) determines the maximum lateral dimensions of the structure above the suction plate.

2. A vacuum gripping apparatus according to claim 1, characterized in that the outer circumference (12) of the suction plate (3) is arranged in the form of a regular polygon.

3. A vacuum gripping apparatus according to claim 2, characterized in that the outer circumference (12) of the suction plate (3) is arranged in the form of a hexagon.

4. A vacuum gripping apparatus according to claim 1 characterized in that the side edges (21) of the suction plate (3) are arched.

5. A vacuum gripping apparatus according to claim 1 characterized in that the corner portions (19) are beveled.

6. A vacuum gripping apparatus according to claim 1 characterized in that the outermost circumference of the vacuum gripping apparatus (1) comprises the outer circumference (12) of the suction plate (3).

7. A vacuum gripping apparatus according to claim 1 characterized in that the outer circumference (12) of the suction plate (3) forms the outermost circumference of the vacuum gripping apparatus (1).

8. A vacuum gripping apparatus according to claim 1 characterized in that the underside of the suction plate (3) is provided with a seal arrangement (7 to 11), the outermost seal (11) of which follows the contours of the outer circumference (12) of the suction plate (3).

* * * * *